US006561954B1

(12) United States Patent
Smith

(10) Patent No.: US 6,561,954 B1
(45) **Date of Patent: *May 13, 2003**

(54) TIMING PAD

(76) Inventor: Robert S. Smith, 1263 Emory St., San Jose, CA (US) 95126

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 392 days.

(21) Appl. No.: 09/649,412

(22) Filed: Aug. 26, 2000

Related U.S. Application Data

(60) Provisional application No. 60/150,931, filed on Aug. 26, 1999.

(51) Int. Cl.[7] ..... A63B 23/00

(52) U.S. Cl. ..... 482/15; 482/14; 482/8; 482/80

(58) Field of Search ..... 482/1–9, 14–17, 482/51, 74, 79, 80, 900–902, 148; 368/1, 10, 2, 3

(56) References Cited

U.S. PATENT DOCUMENTS

| | | | | |
|---|---|---|---|---|
| 5,125,647 A | * | 6/1992 | Smith | 482/8 |
| 5,452,269 A | * | 9/1995 | Cherdak | 368/10 |
| 6,181,647 B1 | * | 1/2001 | Tipton et al. | 482/8 |

* cited by examiner

*Primary Examiner*—Glenn E. Richman
(74) *Attorney, Agent, or Firm*—Robert S. Smith

(57) ABSTRACT

An apparatus for improving jumping skill including an adjustable height platform and a pad with a clock enabling an athlete to stand on the platform and jump onto the timing pad then immediately jump off the board. The contact time of the athlete on the board is recorded by the timing device.

5 Claims, 2 Drawing Sheets

TIMING PAD

This application is a nonprovisional application of provisional application 60/150,931 filed Aug. 26, 1999 from which priority is claimed.

BACKGROUND

Many exercise programs involve jumping as a way to improve proficiency in the chosen sport. Consequently, there are tables on the market having a fixed height with which the athlete exercises by jumping onto one table and down to the floor and going from one table to another around the gym. These tables have a fixed height so that if the athlete wants a range of difficulty he must have a number of tables.

The jumping exercise is an example of pliometric exercises which involve the storage of elastic energy in the musculature. Pliometric exercises (such as jumping) involve imposing a sudden force to store elastic energy which is then released in reaction to the applied force.

Explosive strength developed by pliometric exercise is an important factor in performance of many activities. This is particularly true in activities involving jumping and quick starts.

However these exercises can be very dangerous, primarily, because the height of the tables is fixed and the athlete may jump from a height at which is too high for the state of his physical capabilities.

The ability to perform pliometric jumping exercise where the applied force is controllable and the reactive impulse developed by the body is measurable is highly desired, and is not available in today's training facilities.

SUMMARY OF THE INVENTION

It is an object of this invention to provide an apparatus and a method for practicing a jumping exercise in which the force imposed on the body is easily adjustable in small increments. It is a further object that the magnitude of the impulse to the applied force by the body be controllable and measurable.

This invention is directed toward a platform in which the distance of the platform above a base supporting surface (the floor) is conveniently adjustable in small measurable increments. The apparatus further includes a timing pad positioned next to the platform. The third component is a means to measure a distance that the athlete jumps from the timing pad after the athlete lands onto the timing pad.

The method of the invention is that the athlete 1. positions the platform at a height that is selected according to his capabilities.
2. The athlete steps up onto the platform 3.
3. The athlete jumps onto the timing pad (from the platform)
4. The athlete immediately performs a broad jump off the pad.
5. A clock coupled to the platform measures the length of time that the athlete is in contact with the timing pad (the contact time)
6. The athlete measures the distance he has broad jumped from the timing pad.
7. The athlete computes the force he has generated during the jump by dividing the length of the jump by the contact time.

The platform support is a pair of uprights with an array of apertures in each upright. A pair of angle brackets is attached to the platform (one bracket for each upright). Each bracket has a hook and stud that engage the respective upright.

In one embodiment, an additional step platform is attachable to the platform that is an aid to mounting the platform.

In another embodiment, The base of uprights is å low platform with a wheel. To use the wheel, the platform is removed, and the athlete stands on one lg on the base and strokes the wheel with the other leg thus performing "one legged sprints.

A d c generator is coupled to the wheel and generates a voltage that displays as speed of the wheel.

DESCRIPTION OF A PREFERRED MODE

Figure 1:
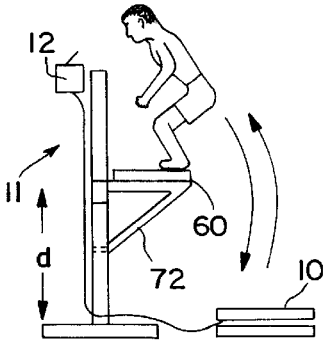
FIG. 1 shows an athlete using the invention to perform one exercise.
Figure 2:
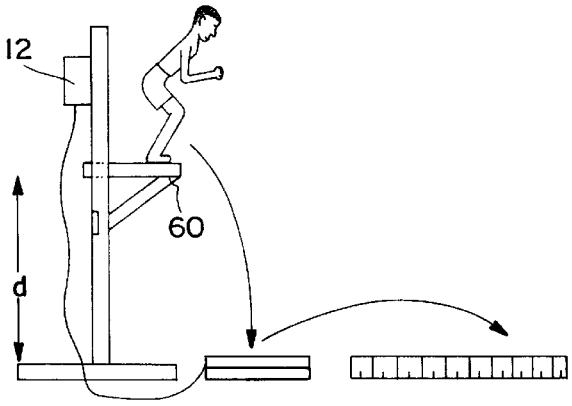
FIG. 2 an athlete using the invention to perform another exercise.

Turning now to a discussion of the drawings, FIGS. 1 and 2 show exercises performed on the apparatus of this invention, the apparatus includes a platform 60 supported on a base and a timing pad 10 next to the base. The distance d is conveniently adjustable.

FIG. 1 shows one exercise in which the athlete jumps from the platform down onto the timing pad then back onto the platform.

FIG. 2 shows another exercise in which the athlete jumps from the platform down onto the timing board and then performs a broad jump.

Figure 3:
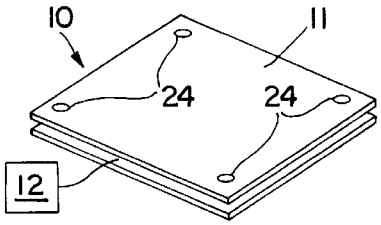
FIG. 3 shows the timing pad of this invention.
Figure 4:
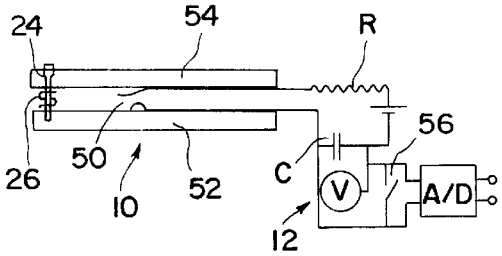
FIG. 4 shows details of the timing circuit of this invention.

The time of contact of the athlete with the board is measured by a timing circuit FIGS. 3 and 4 show in greater detail components of the timing board including a momentary switch 50 between two boards 52, 54 held together by four bolts 24 and springs 26 The four bolts 24 are shown in FIG. 3. The switch 50 is connected in series to a resistor R and a capacitor C. A voltmeter V displays the charge (voltage) accumulated in the capacitor C when switch 50 closes and therefore indicates the time that switch 50 is closed. The timing circuit is reset by closing switch 56 thereby discharging the capacitor.

When the athlete stands on the pad, switch 50 closes and capacitor C starts to charge. The voltmeter V displays the voltage on capacitor C and therefore indicates the length of the time the capacitor is charging.

In performing the exercises shown in FIGS. 1 and 2, the athlete jumps down on timing pad 60 and immediately jumps back up on the platform. The display circuit 12 indicates the time he is in contact with the timing pad 60.

The impulse which the athlete develops is indicate by the distance the athlete jumps from the pad divided by the time in contact with the pad.

Figure 5:
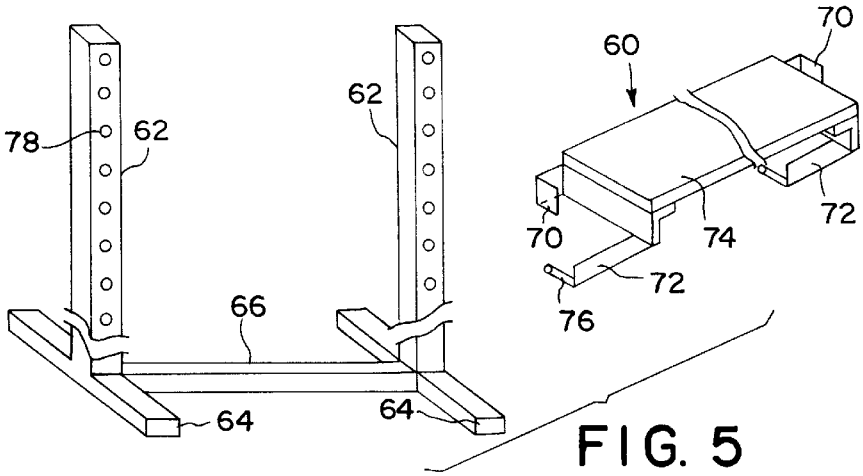
FIG. 5 shows details of the adjustable height platform of this invention.

The height of the takeoff platform above the timing pad is adjustable. Details of the for the takeoff platform are shown in FIG. 5. There are shown two vertical standards 62 with feet 64 and link 66. The takeoff platform 60 includes a panel 74 with a pair of hooks 70 on one pair of neighboring corners and a pair of braces 72. Each brace is attached at one end to another pair of corners of timing pad 60. The other end of each brace 72 has a stud, 76. Each stud disengagingly engages a selected one of the apertures 78 when the hooks 70 engage (hook) the respective vertical standard 78.

Figure 6:
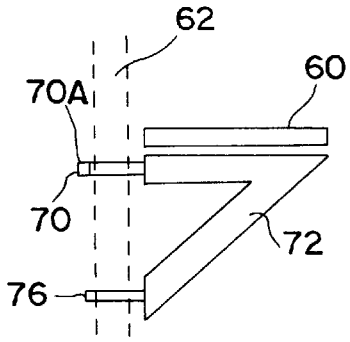
FIG. 6 shows details of the brace.
Figure 7:
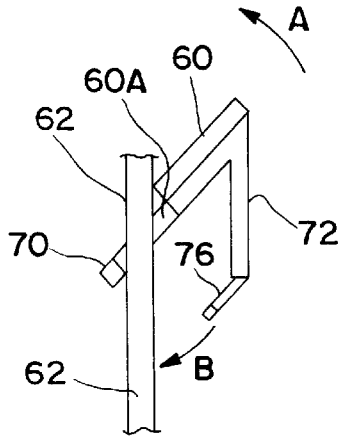
FIG. 7 shows the method for moving the brace.
Figure 8:
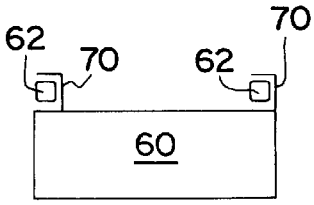
FIG. 8 shows the arrangement for detaching the platform.

Detachable engagement of each brace is illustrated in FIGS. 6, 7 and 8.

FIG. 6 is a side view showing the stud 76 inserted into the upright 62. (Upright 62 shown in phantom in FIG. 6.)

FIG. 7 shows the step for disengaging the platform 60 from the upright 62 to reposition the platform 60. To disengage, the platform is tilted up in the direction of arrow A so that the stud 76 is pulled out of the aperture in the upright. After the platform 60 is repositioned at the required location, the platform is rotated downward (arrow B) to insert the stud 76 into the selected aperture 78 (Apertures 78 are shown in FIG. 5.) An important requirement is sufficient space between the edge 60A of board 60 and the end 70A of hook 70 in order to permit withdrawing the stud 76 from the aperture 78, in the upright 62.

FIG. 8 is a top view showing the hooks 70 facing in one direction. This enables complete separation of the platform from the uprights 662 when required.

Figure 9:
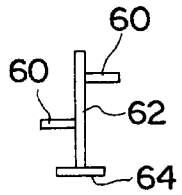
FIG. 9 shows an additional step platform.

FIG.9 shows the apparatus equipped with a "step up" platform 66 below the jump platform 60 on which the athlete can first step in order to step on the higher platform 60. The step up platform 66 is detachably attachable from the uprights 62 as discussed in connection with the jump platform 60.

Figure 10:
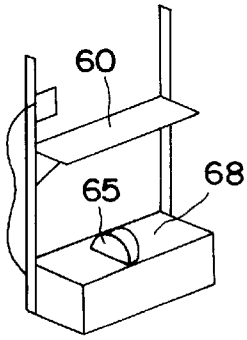
FIG. 10 shows a sped wheel combined with the jumping platform.

FIG. 10 shows a speed wheel 65 which the athlete uses by removing the jump platform 60 enabling him to stand on one leg on surface 68 on one leg and stroke the wheel with the other leg. A dc generator (not shown) and the wheel are mounted on a common shaft so that voltage generated when the wheel is turned indicates speed of the wheel.

There has been described an apparatus and method for developing the explosive strength necessary for quickness and jumping. Three quantifies are involved. The first is height of the jump from the platform onto the timing pad. The second is the contact time with the timing pad. The third is the distance jumped from the timing pad. The invention comprises both the apparatus and the method of use.

Variations and modification of this invention may be contemplated after studying the specification and drawings which are within the scope of the invention.

Figure 11:
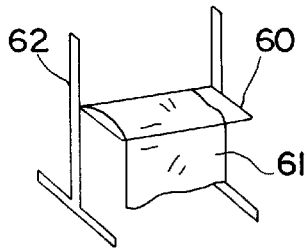
FIG. 11 shows a protective mat on the device.

For example, FIG. 11 shows a mat 61 draped over the platform 60 to prevent inadvertent injury to the athlete in case he falls against the platform 60.

I therefore wish to define the scope of my invention by the appended claims.

I claim:

1. An apparatus for performing jumping exercises comprising:

a pair of uprights;

means for supporting each upright vertically side by side, on a base surface;

a platform;

means for detachably securing said platform to said uprights at a selected height selected from a range of heights;

a timing pad;

a timing means coupled to said timing pad for measuring a period of time when an athlete is in contact with said base surface whereby an athlete is enabled to:

(i) position said platform at a selected distance from said base surface;

(ii) stand on said platform, (iii) jump off said platform onto said pad and then jump off said pad enabling said athlete to measure a length of time he is in contact with said pad and a distance he jumps from said pad.

2. The apparatus of claim 1 wherein said means for detachably securing said platform comprises:

each said upright having a row of apertures extending along one elongated side of said upright;

a pair of braces, one brace attached to one end of said platform for attaching said one end of said platform to one said upright and another brace attached to an opposite end of said platform for attaching said opposite end of said platform to another said upright;

each said brace having a hook and a stud arranged to permit inserting said stud into a selected aperture of a respective one of said uprights while engaging said hook with said respective upright in an operable arrangement to permit detachably attaching said platform to said upright at said selected distance.

3. The apparatus of claim 1 wherein said timing pad comprises:

a pair of panels;

spring fasteners for coupling one said panel to another said panel; and said timing means comprises:

a normally open switch operably arranged to close when one said panel is forced toward said other panel;

a timing circuit means connected across said switch measuring a period of time when said switch is closed.

4. The apparatus of claim 3 wherein said timing circuit comprises:

a resistor;

a capacitor, a source of d.c. voltage;

a voltmeter;

said resistor, capacitor, source and voltmeter operably arranged and connected to said switch to provide that when said switch is closed, a voltage across said capacitor increases and is measured by said voltmeter whereby a period of time of switch closure is indicated by said voltmeter.

5. The apparatus of claim 1 wherein said means for supporting each upright vertically side by side, on a base surface comprises:

a wheel;

platform means for rotatably supporting said wheel to rotate on an axle;

a dc voltage generator mounted on said axle providing that a dc voltage is generated when said generator and wheel rotate on said axle;

meter means for indicating said voltage;

said wheel and platform arranged in operable combination to permit a user to stand on one leg on said platform means and stroke said wheel with said another leg.

* * * * *